US005511311A

United States Patent [19]

Collins

[11] Patent Number: 5,511,311

[45] Date of Patent: Apr. 30, 1996

[54] KNIFE WITH SLIDING BASE

[76] Inventor: Walter W. Collins, P.O. Box 100, North, S.C. 29112

[21] Appl. No.: 180,880

[22] Filed: Jan. 12, 1994

[51] Int. Cl.[6] ..... B26B 1/08; B26B 29/02

[52] U.S. Cl. ..... 30/162; 30/151; 224/232; 224/242

[58] Field of Search ..... 30/2, 26, 27, 151, 30/162, 163, 320, 143; 224/232, 233, 242; 606/167

[56] References Cited

U.S. PATENT DOCUMENTS

| | | | |
|---|---|---|---|
| 292,917 | 2/1884 | Kaldenbach | 30/162 |
| 317,208 | 5/1885 | Rockwell | 30/163 |
| 373,580 | 11/1887 | Boynton | 30/162 |
| 515,743 | 3/1894 | Von Bültzingslöwen | 30/163 |
| 1,546,709 | 7/1925 | Bott | 30/162 |
| 1,888,887 | 11/1932 | Readman | 30/162 |
| 2,112,518 | 3/1938 | Caplan | 30/162 X |
| 2,243,030 | 5/1941 | Fischer | 30/162 X |
| 2,260,141 | 10/1941 | Hanle | 30/163 |
| 2,284,168 | 5/1942 | Rickenbacher | 30/162 X |
| 2,474,609 | 3/1946 | Wolf | 30/162 |
| 2,552,945 | 5/1951 | Eaton et al. | 30/162 |
| 2,874,462 | 2/1959 | Benedict, Jr. et al. | 30/162 |
| 4,265,017 | 5/1981 | Collins | 30/162 |
| 4,523,379 | 6/1985 | Osterhout et al. | 30/162 X |
| 4,592,140 | 6/1986 | Chasen | 30/162 X |
| 4,835,863 | 6/1989 | Salandre | 30/151 X |
| 4,926,555 | 5/1990 | Lemaire | 30/162 |
| 4,961,523 | 10/1990 | Stimac | 30/151 X |
| 4,964,554 | 10/1990 | Collins | 30/151 X |
| 5,025,557 | 6/1991 | Perreault | 30/151 |
| 5,146,684 | 9/1992 | Hagler | 30/162 |
| 5,255,436 | 10/1993 | Yoshida | 30/151 |
| 5,297,341 | 3/1994 | Collins | 30/162 |
| 5,315,761 | 5/1994 | Norton et al. | 30/162 |
| 5,379,520 | 1/1995 | Collins | 30/151 X |

FOREIGN PATENT DOCUMENTS

| | | |
|---|---|---|
| 157984 | 4/1883 | France . |
| 327051 | 12/1902 | France . |
| 1122971 | 9/1956 | France . |
| 5487 | of 1884 | United Kingdom . |
| 17425 | of 1893 | United Kingdom . |

*Primary Examiner*—Kenneth E. Peterson
*Assistant Examiner*—Clark F. Dexter
*Attorney, Agent, or Firm*—Leatherwood Walker Todd & Mann

[57] ABSTRACT

A knife having a sliding blade which may slide from a retracted position to an extended position. A locking member is pivotally connected to the blade and travels with the blade as the blade moves within a handle. A finger on the locking member engages with a recess to selectively lock the blade within the handle. By rocking the locking member forward, against the pressure of a spring, the blade is pushed outwardly from the handle until the finger automatically seats in an extension notch provided in the handle. Retraction of the knife is accomplished by rocking the locking member forward and pulling rearwardly thereon to force the blade back into the handle. A sheath for the knife engages the locking member to automatically lock the knife within the sheath upon insertion into the sheath. Upon extraction of the knife from the sheath, the blade is automatically extended.

7 Claims, 5 Drawing Sheets

Fig. 1
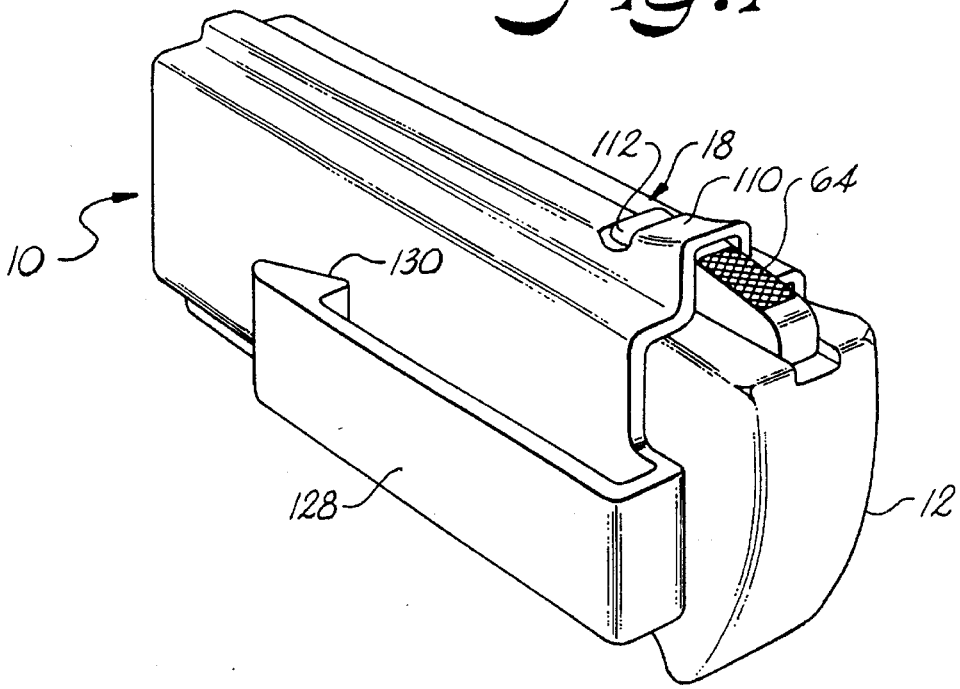
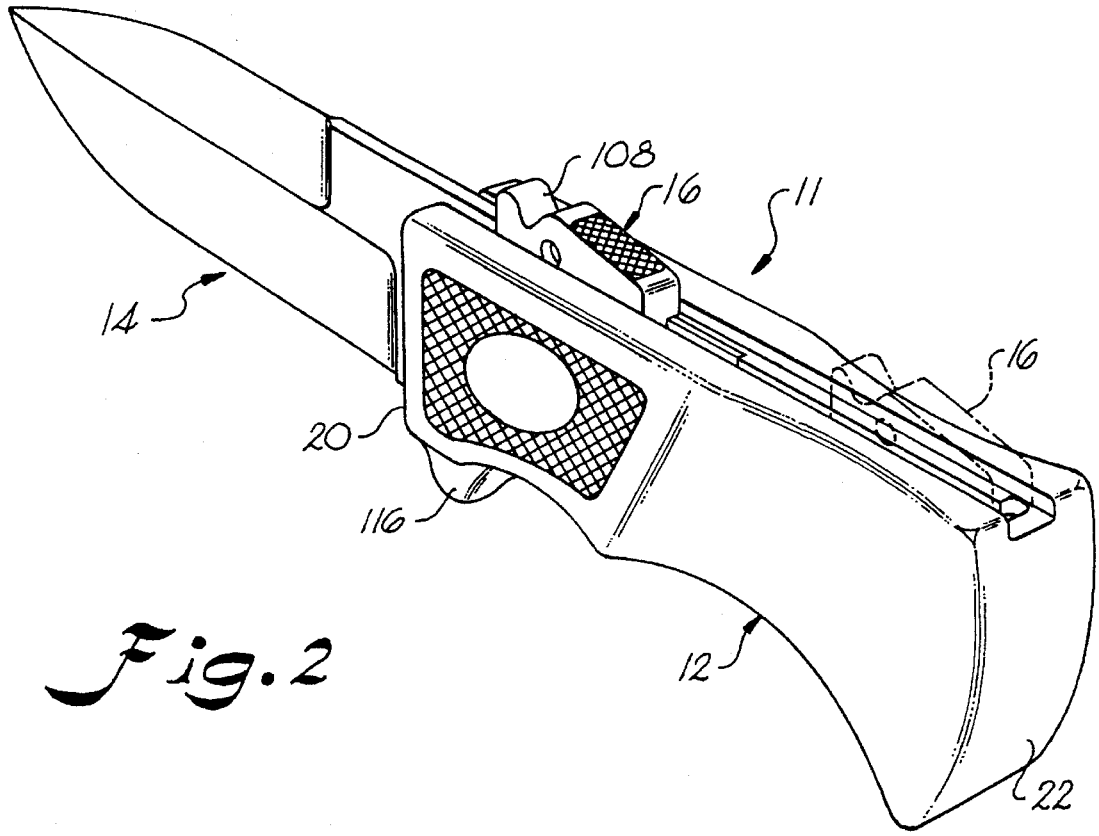
Fig. 2

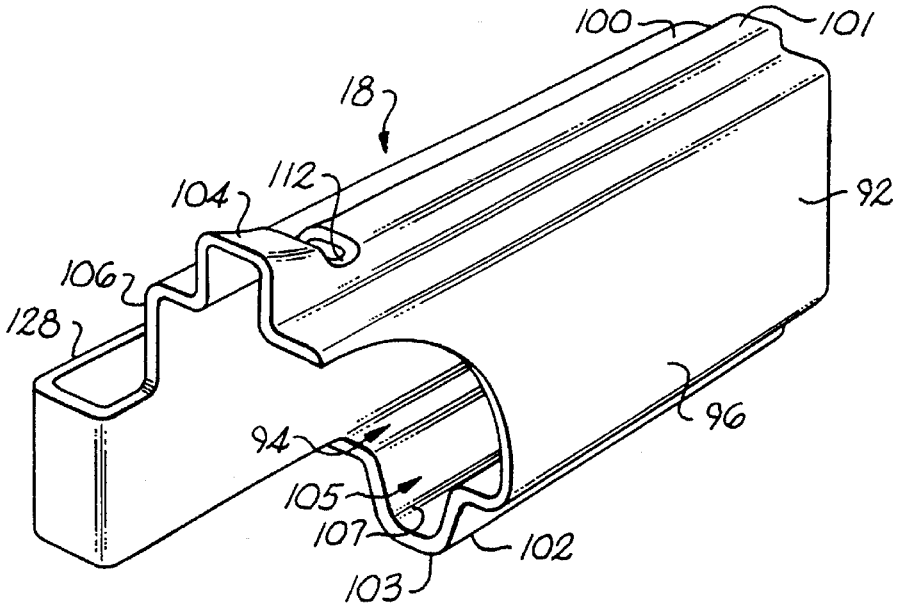
Fig. 4
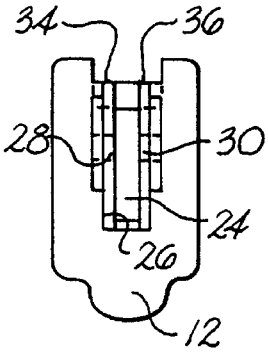
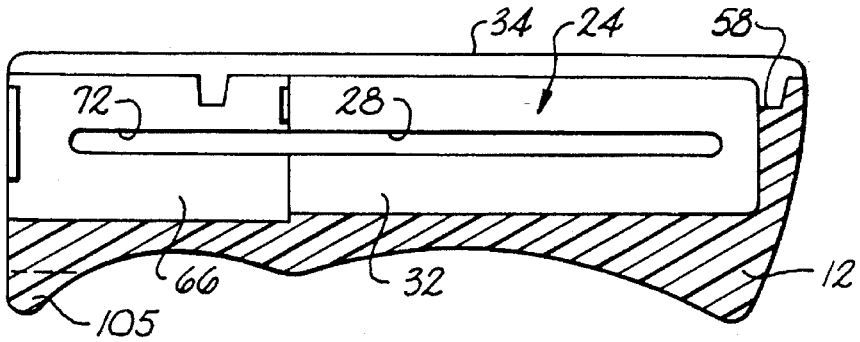
Fig. 5A
Fig. 5

KNIFE WITH SLIDING BASE

BACKGROUND OF THE INVENTION

This invention primarily relates to a knife having a sliding blade which automatically locks in an extended or retracted position and which is operable with one hand.

The typical pocket knife is a folding knife which requires two-handed operation. The user must hold the handle of the knife with one hand while the other hand is used to manipulate the blade in order to extract the blade from the handle and pivot it outwardly to an extended, operating position. Once the blade is extended to the operating position, many knives lack a feature which locks the blade in such a position. Accordingly, the knife blade could inadvertently close on the fingers of the user if the user does not exercise proper care. Additionally, when such folding knives are in their retracted state, it is often difficult for the user to get the tip of his or her finger or fingernail against the blade in a manner sufficient to pull the blade out from the handle because of the only slight extension of the blade from the handle when the blade is in its retracted state. This can make for difficult or time consuming opening of the blade from the handle.

Also, and importantly, conventional folding knives cannot typically be operated with one hand in an easy manner. Accordingly, if a user has one hand occupied, the user must stop what he or she is doing with that hand in order to open a knife. This can become especially critical in emergency situations when only one hand is available and also for rescue personnel who may be required to exert a force with one hand while reaching for and opening a sharpened knife with the other.

Knives having sliding blades which can be opened with one hand have been disclosed in the past. For example, U.S. Pat. No. 4,926,555, issued to Lemaire, discloses a pocket knife having a button which is pivotally connected to a blade. Rearward pivoting of the button depresses a leaf spring to allow for retraction of the blade within a handle. U.S. Pat. No. 292,917, issued to Kaldenbach, discloses a pocket knife having a push pin which is grasped for moving the knife blade out of the knife. When the push pin reaches an enlarged portion of the guide slot, the push pin is pushed outwardly, thereby locking the blade. U.S. Pat. No. 2,474,609, issued to Wolf, discloses a knife having a blade with a push button provided on a shank of the blade. A spring is attached to the blade, such that when the push button is moved forward, such movement works against the spring. Upon release of the push button, the knife is pulled back into the sheath by the spring.

Other designs disclosed include U.S. Pat. No. 4,592,140, issued to Chasen, which discloses a combination food peeler and slicer having a thumb operating portion which is depressed in order to advance a blade from a handle. U.S. Pat. No. 2,552,945, issued to Eaton, et al., discloses a pocket knife having a latch member which seats in openings for locking the blade in a partially extended, or extended, position, respectively. U.S. Pat. No. 1,888,887, issued to Readman, discloses a pocket knife having a plunger which is depressed by a spring biased finger to a position below longitudinally extending flanges having notches therein. The blade of the knife is locked by releasing the finger, which causes the plunger to engage with a notch in the flanges. French Patent No. 1,122,971, British Patent No. 5,487 and U.S. Pat. No. 317,208, disclose handle-mounted pivotal levers which lock the blade from accidental retraction back into the knife handle.

While prior knife designs having blades which slide between a retracted position and an extended position are available, they present limitations which may interfere with providing a simple, low profile, fast-opening and secure device.

SUMMARY OF THE INVENTION

It is therefore the principal object of the present invention to provide a knife having a retractable blade which can readily be actuated to extend and retract the blade from a knife handle using only one hand.

It is a further object of the present invention to provide a knife having a sliding blade which locks securely in retracted and extended positions.

It is another object of the present invention to provide a knife having a blade which automatically locks in an extended position and which automatically locks in a retracted position.

It is still another object of the present invention to provide a sheath, and a method of use thereof, for carrying a knife constructed in accordance with the present invention which automatically locks the knife therein and which causes the blade to be released from a retracted position upon withdrawal of the knife from the sheath.

These and other aspects of the present invention will become further evident upon reference to the following drawings and accompanying specification.

Generally, one preferred embodiment of the present invention includes a knife having a longitudinally extending blade with a first end and a second end opposite the first end, a first edge and a second edge spaced apart from the first edge, and a first side and a second side opposite the first side. An elongated handle portion is provided which defines a first end and a second end opposite the first end. The handle portion further defines a longitudinally extending blade chamber therein for receipt of the blade. The handle also defines at least one retention recess therein.

The handle includes a blade passage at its first end, the blade passage being in communication with the blade chamber, and the handle being provided with at least one longitudinally extending track in communication with the blade chamber. A pivot member is carried on the first edge of the blade, and a locking member is pivotally connected to the pivot member for rocking between a release position, for allowing movement of the blade with respect to the handle, and a locking position, for restraining movement of the blade with respect to the handle. The locking member defines a first end and a second end opposite the first end.

A spring is associated with the first end of the locking member for biasing the locking member towards the locking position. At least one projection is provided which extends outwardly from at least one of the first and second sides of the blade for sliding engagement with the track in the handle such that the blade can be moved between an extended position, wherein the blade projects outwardly from the handle, to a retracted position, wherein the blade is substantially carried within the handle. Additionally, a downwardly extending finger is provided on the second end of the locking member for automatically engaging the retention recess provided in the handle when the blade is in the extended position, to selectively lock the blade in the extended position.

Also, a sheath is provided for a knife having a retractable blade and for automatically causing the blade to extend from a handle of the knife as the knife is withdrawn from the sheath, the sheath including an elongated body member defining an elongated knife receptacle therein for receipt of the knife.

The body member includes a first end and a second end opposite the first end, the first end being open and in communication with the knife receptacle. The body member defines a front wall and a rear wall spaced opposite the front wall, the front wall and the rear wall being separated by the knife receptacle. The body member further defines a first side wall and a second side wall spaced opposite the first side wall and being separated by the knife receptacle.

An angled flange is provided adjacent the first end of the body member and defines a blade release recess therein. A fastening device is attached to the sheath adjacent the first end of the body member for selectively attaching the sheath to an article.

The knife receptacle, the angled flange, and the blade release recess are configured such that upon withdrawal of a knife from the blade receptacle, the blade release recess engages a portion of the knife to cause the blade of the knife to be extended as the handle of the knife is withdrawn from the sheath.

BRIEF DESCRIPTION OF THE DRAWINGS

The foregoing, as well as other objects of the present invention, will be further apparent from the following detailed description of the preferred embodiment of the invention, when taken together with the accompanying drawings, in which:

FIG. 1 is a perspective view of a knife and sheath constructed in accordance with the present invention;

FIG. 2 is a perspective view of a knife constructed in accordance with the present invention having a blade in an extended position;

FIG. 4 is a perspective view of a sheath constructed in accordance with the present invention;

FIG. 5 is a sectional view, taken along lines 5—5 of FIG. 3;

FIG. 5A is an end view of a knife handle constructed in accordance with the present invent

DESCRIPTION OF THE PREFERRED EMBODIMENT

Figure 3:
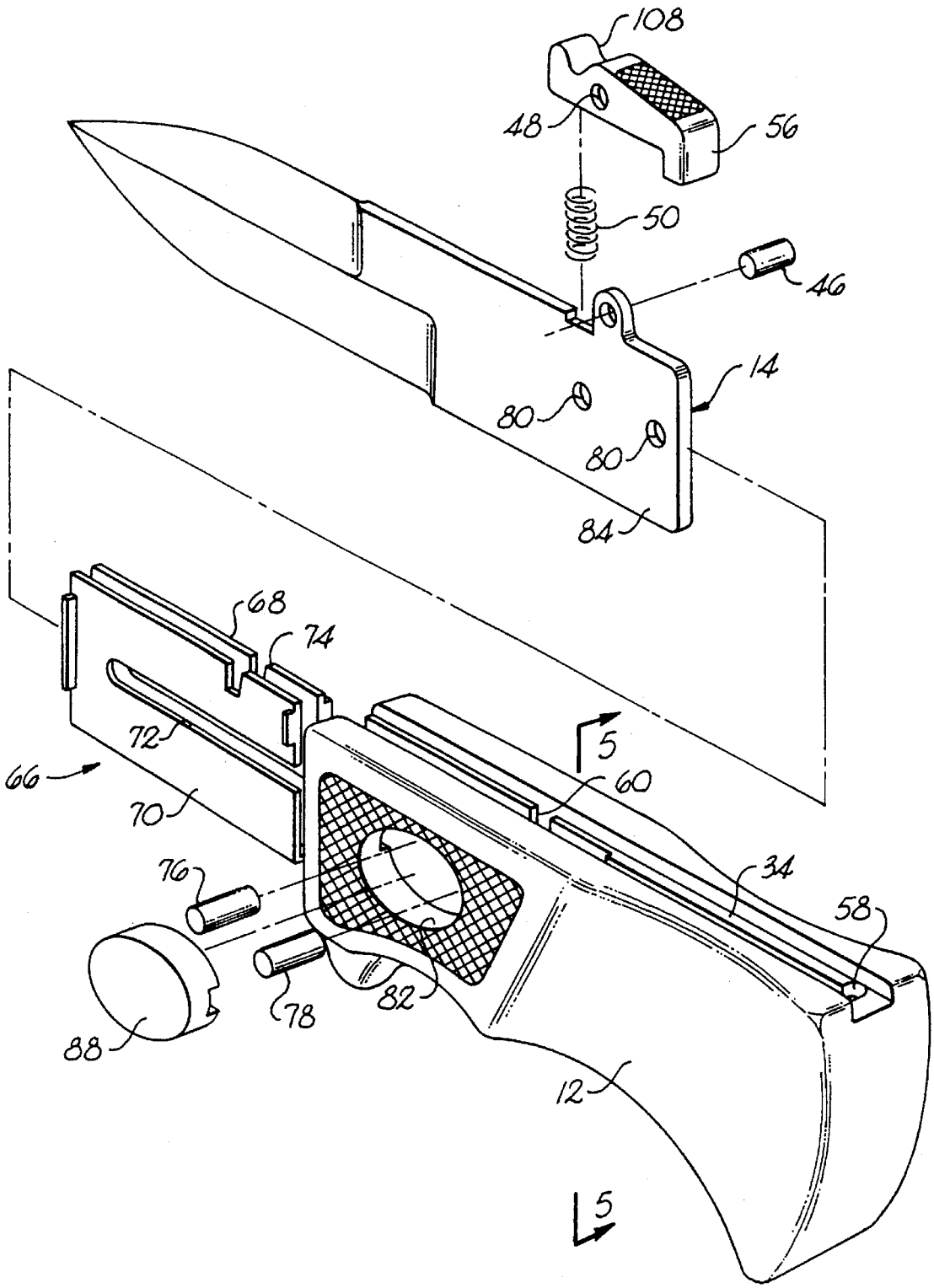
FIG. 3 is an exploded perspective view of a knife constructed in accordance with the present invention.

Referring to the drawings in detail, wherein like reference characters represent like elements or features throughout the various views, the knife with sliding blade and sheath of the present invention are designated generally in the Figures by a reference character 10.

Referring to the Figures, and in particular to FIG. 1 of the drawings, the knife 11 includes an elongated handle, generally 12, an elongated blade, generally 14, a locking member, generally 16, and is adapted for receipt in a sheath, generally 18. The handle 12 includes a first end 20 and an opposing second end 22. As shown in FIGS. 5 and 5A, the handle 12 is provided with a longitudinally extending blade chamber 24 which extends substantially the length of handle 12. Adjacent the first end 20 of the handle, a blade passage 26 is provided which is in open communication with the blade chamber 24.

Figure 6:
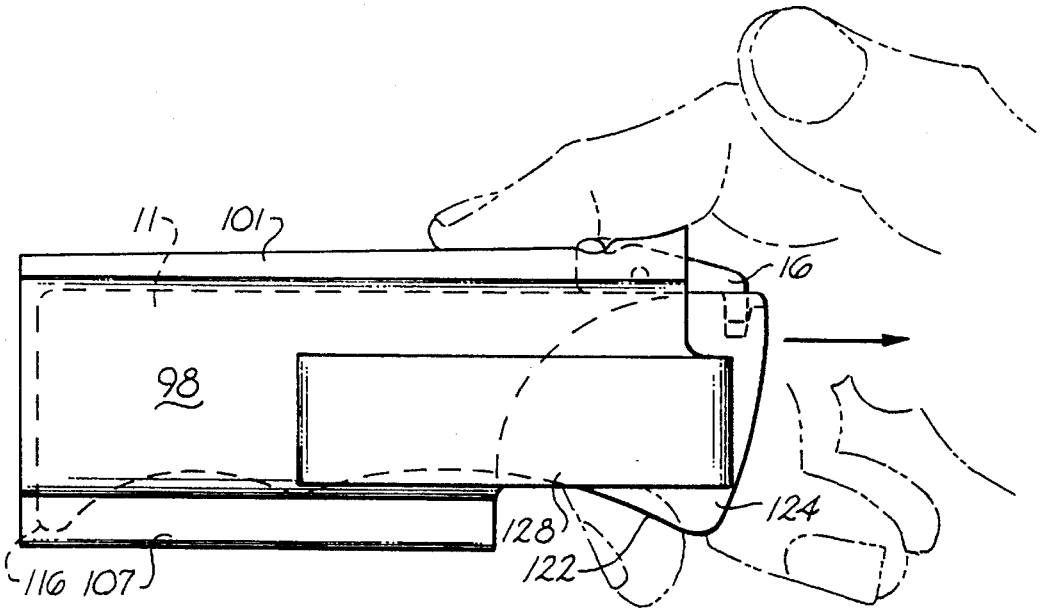
FIG. 6 is a side elevational view of a knife and sheath constructed in accordance with the present invention.
Figure 7:
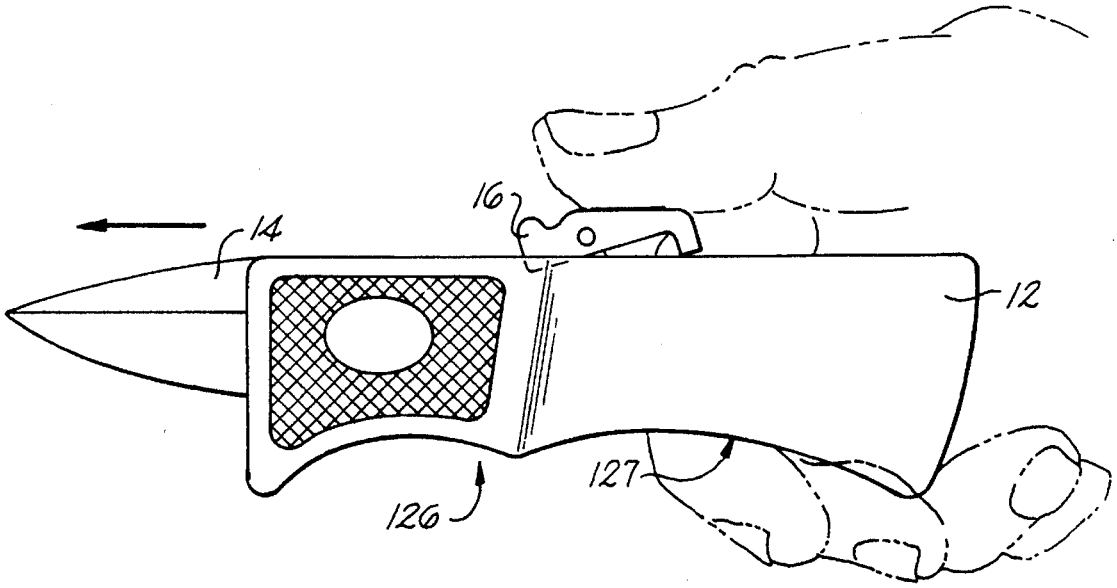
FIG. 7 is a side elevational view of a knife constructed in accordance with the present invention, illustrating the blade being moved to an extended position.
Figure 8:
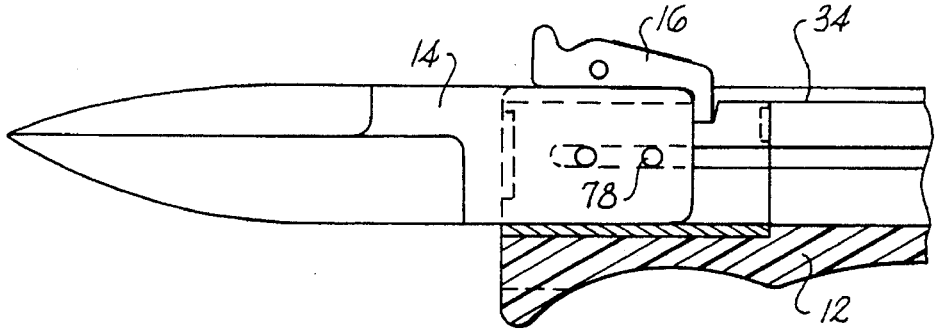
FIG. 8 is a partial sectional view of a knife constructed in accordance with the present invention.
Figure 11:
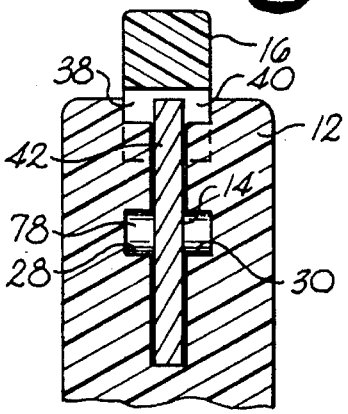
FIG. 11 is a sectional view,taken along lines 11—11 of FIG. 10.

The blade 14 is movable between a retracted position, as illustrated in FIGS. 1 and 6, wherein the blade 14 is received within the blade chamber 24, to an extended position, as illustrated in FIGS. 2, 7 (showing a partial extension of blade 14) and 8. As shown in FIG. 11, longitudinally extending tracks 28, 30 are defined in the walls 32 of the blade chamber 24 and extend the length of the blade chamber 24. The handle 12 also defines rails 34, 36 extending substantially parallel to one another and extending the length of the handle 12 and extending substantially perepndicularly to the side walls 32 of the blade chamber 24. Downwardly extending portions 38, 40 of locking member 16 engage the rails 34, 36 as the blade 14 is moved between the retracted and extended positions.

Figure 9:
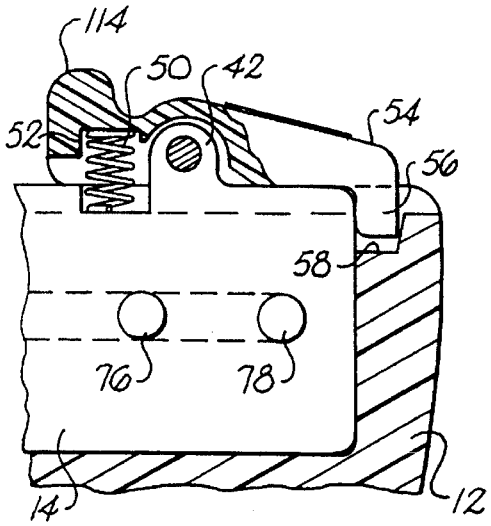
FIG. 9 is a partial sectional view of a knife constructed in accordance with the present invention.
Figure 10:
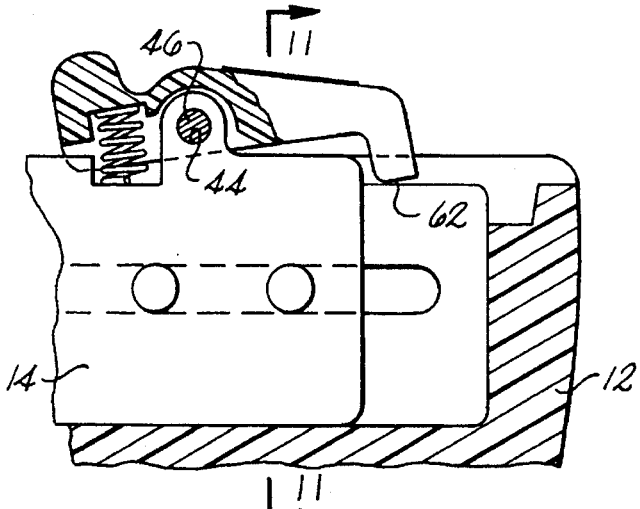
FIG. 10 is a partial sectional view of a knife constructed in accordance with the present invention.

As shown in FIGS. 3, 9 and 10, locking member 16 is attached to a pivot member 42 which is connected on an upper edge of blade 14 The pivot member is provided with a bore 44 through which a pivot pin 46 passes. The pivot pin 46 is received in a bore 48 provided in locking member 16 such that locking member 16 is free to pivot about the pivot member 42. A coil spring 50 is provided which biases a first end 52 of the locking member 16 upwardly, which in turn biases the second end 54 of the locking member 16 downwardly. It is to be understood that other spring members could be used instead of a coil spring, including a leaf spring, a rubber member, or any other resilient device.

Downwardly extending from the second end of the locking member is a finger 56 which may automatically engage with notches 58, 60 provided in an upper portion of the handle and defined in the rails 34, 36. Preferably, at least two notches are provided, namely, a retention notch, or recess 58, in which the downwardly extending projection, or finger 56, is received when the blade 14 is in the retracted position, and an extension recess 60, in which the finger 56 is received when the blade 14 is in an extended position.

Upon depression of the end of the locking member 16 adjacent the coil spring 50, the finger 56 rises upward, and further depression on the forward end 52 of the locking member causes the blade to advance outwardly from the handle 12. However, when the blade reaches the fully extended state, the finger 56 automatically moves downwardly and engages the extension recess 60, under influence of the coil spring pressing on the other end 52 of the locking member 16. This results in the blade being securely locked in the extended position, and the blade cannot be withdrawn back into the handle until the end 52 of the locking member 16 is deliberately depressed, against the force of the spring 50, such that the finger 56 rises above and clears the extension recess 60.

When the blade 14 is brought rearwardly, a forward edge 62 of the finger 56 may engage and slide on the rails 34, 36 to facilitate a smoother retraction of the blade into the handle. Upon the furthermost extent of the rearward movement of the blade into the handle 12, the finger 56 will automatically seat itself in the retention recess 58 to securely lock the blade within the blade chamber 24 until the other end 52 of the locking member 16 is deliberately depressed to allow the blade to move towards the extended position.

The contact portion 64 of the locking member 16 is preferably knurled or otherwise textured to facilitate contact with, or purchase on, the member when rocking the locking member 16 and when pushing on the locking member to advance or retract the blade.

A frame member 66 is provided, as illustrated in FIG. 3, which includes two substantially parallel members 68, 70 having tracks 72 defined therein which cooperate with the tracks defined in the side walls 32 of the blade chamber 24. Notches 74 are also provided in upper surfaces of the frame member which cooperate with the notches 60 provided in the rails of the handle 12. The frame member 66 is preferably constructed of metal, such as steel, while the handle is preferably constructed of plastic, glass-filled nylon, wood or the like, although metal, or any other suitable material, could be also used. The metal frame structure 66 is fixedly received in the blade chamber 24, and the blade 14 moves slidingly between the walls of the frame member. The metal frame member serves to strengthen and add rigidity to the knife, particularly when the knife is in the extended position. The tracks of the metal frame also allow for a metal-to-metal contact between the metal pins 76, 78 of the blade 14 to add further rigidity to the knife during cutting actions using the blade The projections, or pins 76, 78, are provided which extend substantially perpendicularly and outwardly from each side of the blade. Although two pins 76, 78 are illustrated as being received in bores 80 defined in the blade, it is to be understood that a single pin or more than two pins could also be used. Further, it is to be understood, that projections other than the pin structures illustrated could also be used. The pins 76, 78 are received in and engage the tracks defined in the handle 12 and frame member 66 and serve to align and carry the blade 14 as it moves to and fro within the handle.

An access opening 82 is provided in the side of the handle for allowing the pins 76, 78 to be inserted in the second end 84 of the blade, through the bores 80 of the blade, such that the ends of the pins are received in the tracks defined in the handle 12 and frame member 66, respectively. A cap 88 is also provided which is received in the opening for concealing and containing the pins 76, 78 within the blade upon final assembly of the knife 11. Such a configuration provides for a knife having a streamlined appearance and for a unique method of assembly and manufacturing.

In assembling knife 11, a bar handle 12 is provided which includes the blade chamber 24, blade passage 26, tracks 28, 30, rails 34, 36, and notches 58, 60 defined therein. Frame member 66 is fixedly attached in the interior of blade chamber 24 adjacent to blade passage 26. The second end 84 of blade 14 is inserted within frame member 66 such that bores 80 are in alignment with tracks 72 of frame member 66 and with tracks 30 of handle 12. Pins 76, 78 are then inserted by way of 28, access opening 82 through track 72 of frame member 66, track 30 of handle 12, bores 80 of blade 14, and into track 28 of handle 12. Upon insertion of pins 76, 78 into bores 80, the end portions of pins 76, 78, respectively, extend outwardly from both sides of blade 14 into mating engagement with tracks 28, 30 of handle 12 and track 72 of frame member 66. By providing pins 76, 78 in blade 14, blade 14 is allowed to slide smoothly into and out of blade chamber 24. Also, because pins 76, 78 are spaced apart from one another, and because of the engagement of pins 76, 78 with tracks 72 of frame 66, when blade 14 is in an extended position, the blade will be rigidly held in handle 12 during use.

After pins 76, 78 have been installed in blade 14, cap 88 is inserted into access opening 82 and is preferably permanently fixed therein through the use of an adhesive or other suitable fastening means. The resulting knife 11 thus provides for support and carriage of blade 14 without having exposed blade fastening means, such as screws, rivets, or the like.

As illustrated in FIGS. 1, 4, and 6, the sheath 18 for carrying the knife 11 of the present invention is also disclosed. The sheath 18 includes an elongated body member 92 which defines a knife chamber 94, or receptacle, which is elongated for receiving the knife of the present invention when the blade 14 is in its retracted position. The knife receptacle 94 is defined by front and rear walls 96, 98 and opposing side walls 100, 102. Side wall 100 includes an elongated channel 101 for receipt of the upper portions of handle 12 and blade 14. A locking member engagement structure, such as an angled flange portion 104 is provided adjacent one end 106 of the body member 92 for slidingly receiving the locking member 16 of the knife when the knife is inserted into the sheath.

A sheath retention structure, for example, a groove 108, is provided for the locking member 16 of the knife 11 for engaging with the surfaces 110 adjacent a locking member engagement structure, such as slot 112, provided in the angled flange portion 104 of the sheath. Upon insertion of the knife within the sheath, the curved leading edge 114 of the locking member 16 engages the angled flange 104, and as the knife is inserted further into the sheath, the interaction between the angled flange 104 and the leading edge 114 of the locking member causes the locking member to rock forward slightly, towards the locking member blade release position. Upon full insertion of the knife within the sheath, the leading edge portion clears the angled flange 104 and extends upwardly through the slot. Preferably, the spring 50 is slightly compressed at this point and, accordingly, forces tab 116 of the handle against wall surfaces 107 of channel 105, which insures a snug fit of the knife within the sheath. Engagement of the groove 108 with the angled flange engagement surface 110 adjacent the slot 112 locks the knife within the sheath automatically.

When it is desired to withdraw the knife from the sheath, the engagement of the groove 108 With the flange portion of the sheath is such that upon slight pressure being applied to the curved portion 122 of the second end 124 of the grip portions 126, 127 of the handle in a direction towards the slot, the locking member is rocked slightly such that it is in a release position. Upon further withdrawal of the knife from the sheath, the continued engagement of the groove with the flange portion causes the blade to remain substantially fixed with respect to the sheath as the knife handle 12 is ultimately extracted from the sheath. When the knife handle is extracted to the point where the corner 116 clears the lower edge 103 of the sheath, the locking member disengages with the slot 112, and the knife is pulled free of the sheath. At this point, the blade is in its extended position, and may even be in its fully extended position such that the locking member finger 56 engages with the extension recess 60. This allows for a one-handed removal of the knife from the sheath, whereby the knife is unlocked from the sheath and the blade is moved from its retracted position to its extended position all in one motion.

The sheath 18 is preferably constructed of plastic, glass-filled nylon, or metal although, wood or any other suitable material could also be used.

While a slot 112 of rectangular shape has been illustrated, it is to be understood that a variety of other recess configurations and/or shapes could be provided as well as a variety of other engagement means for the locking member instead of the groove 108 discussed herein. Also, flanges 104 may have a different angle than shown or no angle at all.

A fastening device, or clip 128 is attached to rear wall 96 of sheath 18 adjacent to an end thereof. The clip 128 includes a tapered, free end 130 which, because clip 128 is flexible, can easily flex to slide over a belt, strap, boot upper, or other article. This allows the sheath to be readily attached to a belt or strap without requiring a free end of the belt or strap.

In using the knife, the locking member 16 is rocked forwardly such that the finger 56 clears the retraction recess 58. Continued pressure is then applied to the locking member such that the blade moves outwardly from the blade chamber 24 of the handle to its extended position. Once the blade is in its extended position, the finger of the locking member will automatically seat itself in the extension recess 60 to lock the blade in its extended position. To retract the blade to within the handle, the locking member is simply rocked forward such that the finger 56 clears the extension recess, and continued rearward pressure is applied to the locking member to retract the blade to within the handle to the point where the finger seats in the retraction recess.

The knife is inserted in the sheath such that the leading edge of the locking member 16 contacts with the angled flange 104 of the sheath. Continued forcing of the knife to within the sheath causes the finger of the locking member to rise slightly, as the forward end of the locking member is forced downwardly through contact and interaction with the angled flange. Finally, the forward end of the locking member clears the angled flange and extends upwardly into the slot 112, thereby relaxing the spring beneath the locking member slightly, while still retaining the spring in slight compression such that the knife is snugly held within the sheath and such that the groove provided in the locking member securely engages the angled flange portion adjacent the slot. To remove the knife from the sheath, a slight pressure is provided on the upper end of the knife in a direction towards the slot. This causes the locking member to pivot such that it moves to the release position. While pulling the knife out of the sheath and while applying a continued force towards the slot, the locking member will continue to engage the slot to fix the blade relative to the Sheath as the handle is withdrawn. Ultimately, when the lowermost portion of the handle clears the lower edge 103 of the sheath, the groove of the locking member becomes disengaged with the slot, and the knife can be withdrawn with the blade in a substantially extended or fully extended state.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art, without departing from the spirit or scope of the following claims.

What is claimed is:

1. A sheath for carrying a knife, tile knife having a handle with a retractable blade, said sheath comprising:

an elongated body member defining an elongated knife receptacle therein for receipt of a knife;

said body member including a first end and a second end opposite said first end, said first end being open to said knife receptacle; said body member defining a front wall and a rear wall spaced opposite said front wall, said front wall and said rear wall being separated by said knife receptacle; said body member further defining a first side wall and a second side wall spaced opposite said first side wall and being separated by said knife receptacle; said second side wall being of shorter length than said first side wall;

said first side wall defining flange angled outwardly away from said knife receptacle at said first end of said body member: said flange defining across therein for locking receipt of a portion of the knife; and said first side wall further defining an elongated channel therein adjacent said recess for receipt of a portion of the blade of the knife.

2. The sheath as defined in claim 1, wherein said recess is a slot extending through said flange.

3. The sheath as defined in claim 1, further comprising a fastening device attached to the sheath adjacent said first end of said body member for selectively attaching the sheath to an article.

4. A knife and sheath combination, comprising:

a knife including a longitudinally extending knife blade;

an elongated knife handle defining a first end and a second end opposite said first end, said knife handle defining a longitudinally extending blade chamber therein for receipt of said knife blade;

said knife handle defining a blade passage at said first end of said knife handle, said blade passage being in communication with said blade chamber, said knife blade being movable with respect to said knife handle between an extended position extending outwardly from said handle through said knife passage and a retracted position substantially within said blade chamber;

a locking member connected to said knife blade for moving to a release position to allow movement of said knife blade with respect to said knife handle between said extended and retracted positions;

a sheath having an elongated body member defining an elongated knife chamber therein for receipt of said knife handle and said knife blade;

said body member including a first end and a second end opposite said first end, said first end being open and communication with said knife chamber;

a locking member engagement structure connected to said body member for engaging said locking member, such that upon withdrawal of said knife handle from said knife chamber, said locking member engagement structure engages said locking member to cause said locking member to move to said release position such that said knife blade is extended from said knife handle as said knife is withdrawn from said sheath.

5. The knife and sheath combination as defined in claim 4, wherein said locking member defines a groove receivable by said locking member engagement structure of said body member.

6. The knife and sheath combination as defined in claim 4, wherein said locking member fixes said knife blade engagement with said locking member engagement structure, when said knife is in said knife chamber of said sheath.

7. A method of extending a blade of a knife having an extendable blade, comprising:

providing a knife having an elongated handle defining a blade chamber and a blade movable between a retracted position, wherein said blade is carried within said blade chamber, and an extended position, wherein said blade is extended outwardly from said blade chamber;

providing a locking member connected with said blade and movable to a release position for allowing movement of said blade with respect to said knife between said extended and retracted positions;

providing a sheath defining a knife chamber for receipt of said knife and having a locking member engagement structure for engagement with said locking member of said blade;

inserting said knife into said knife chamber of said sheath, such that said locking member engages with said locking member engagement structure; and withdrawing said knife from said knife chamber of said sheath such that said locking member engagement structure engages said locking member and moves said locking member to said release position, thereby causing said blade to move to said extended position as said knife is completely withdrawn from said sheath.

* * * * *

UNITED STATES PATENT AND TRADEMARK OFFICE

CERTIFICATE OF CORRECTION

PATENT NO. : 5,511,311

DATED : April 30, 1996

INVENTOR(S) : Walter W. Collins

It is certified that error appears in the above-indentified patent and that said Letters Patent is hereby corrected as shown below:

In Column 4, line 21, change "perpndicularly" to --perpendicularly--.
In Column 5, line 27, add the numeral --14.-- after the word "blade".
In Column 7, line 46, add the word --sheath-- in place of the word "Sheath".
In Column 7, line 62, delete the word "tile" and insert the word --the-- therefor.
In Column 8, line 9, insert the word --a-- before the word "flange".
In Column 8, line 11, delete the word "across" and insert the words --a recess-- therefor.
In Column 8, line 46, insert the word --in-- after the word "and".
In Column 8, line 61, insert --against movement with respect to said knife handle through-- after the word "blade".

Signed and Sealed this

Twenty-third Day of July, 1996

*Attest:*

Bruce Lehman

BRUCE LEHMAN

*Attesting Officer*

*Commissioner of Patents and Trademarks*